US008813971B2

(12) United States Patent
Cooke et al.

(10) Patent No.: US 8,813,971 B2
(45) Date of Patent: Aug. 26, 2014

(54) MODULAR SPIRAL SEPARATOR ELEMENTS

(75) Inventors: Graeme Cooke, Carrara (AU); Mark Palmer, Carrara (AU)

(73) Assignee: CPG Resources—Mineral Technologies Pty Ltd, South Brisbane, Queensland (AU)

( * ) Notice: Subject to any disclaimer, the term of this patent is extended or adjusted under 35 U.S.C. 154(b) by 0 days.

(21) Appl. No.: 13/505,295

(22) PCT Filed: Nov. 3, 2010

(86) PCT No.: PCT/AU2010/001463
§ 371 (c)(1),
(2), (4) Date: Jun. 6, 2012

(87) PCT Pub. No.: WO2011/054039
PCT Pub. Date: May 12, 2011

(65) Prior Publication Data

US 2012/0234732 A1 Sep. 20, 2012

(30) Foreign Application Priority Data

Nov. 4, 2009 (AU) ..... 2009905383

(51) Int. Cl.
*B03B 5/00* (2006.01)

(52) U.S. Cl.
USPC ..... 209/459; 209/697

(58) Field of Classification Search
USPC ..... 209/459, 697, 155
See application file for complete search history.

(56) References Cited

U.S. PATENT DOCUMENTS

| | | | | | |
|---|---|---|---|---|---|
| 976,980 | A | * | 11/1910 | Blatch | 209/697 |
| 977,037 | A | * | 11/1910 | Pardee | 209/697 |
| 1,582,503 | A | * | 4/1926 | Benner | 209/697 |
| 2,145,315 | A | * | 1/1939 | Pardee | 209/697 |
| 4,664,789 | A | * | 5/1987 | Lees et al. | 209/459 |
| 4,781,822 | A | * | 11/1988 | Pryor | 209/459 |
| 2008/0207344 | A1 | * | 8/2008 | Huerta et al. | 472/116 |

FOREIGN PATENT DOCUMENTS

| | | |
|---|---|---|
| SU | 1 724 373 | 4/1992 |
| WO | 8504600 | 10/1985 |

* cited by examiner

*Primary Examiner* — Kaitlin Joerger
(74) *Attorney, Agent, or Firm* — Whitham, Curtis, Christofferson & Cook, P.C.

(57) ABSTRACT

The invention provides a spiral separator module 3.010 including at least one trough segment 4.012 having an up stream edge and a downstream edge, each trough segment 4.012 being adapted to interface with at least one other corresponding trough segment 4.012 of a second spiral separator module to form a continuous section of a spiral trough.

49 Claims, 12 Drawing Sheets

FIGURE 1
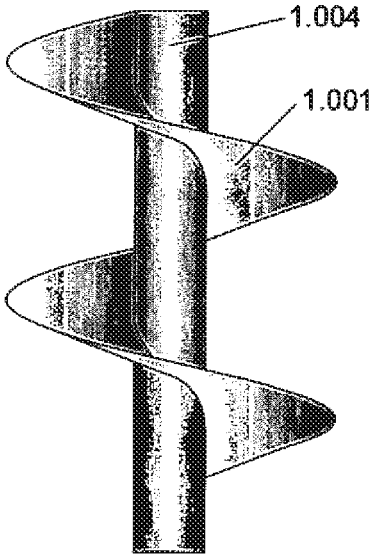
FIGURE 2
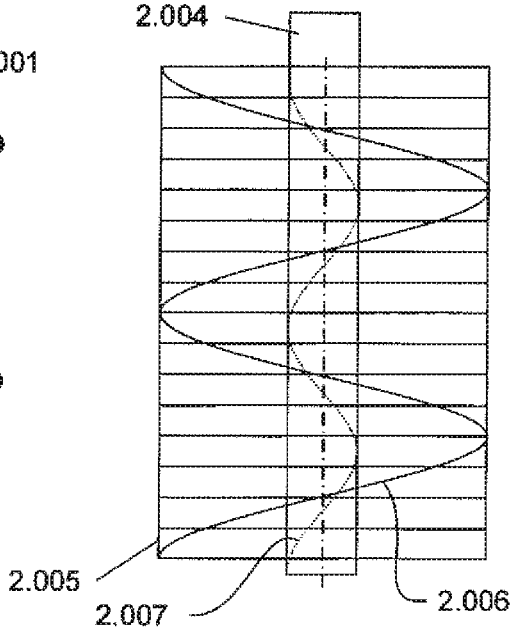
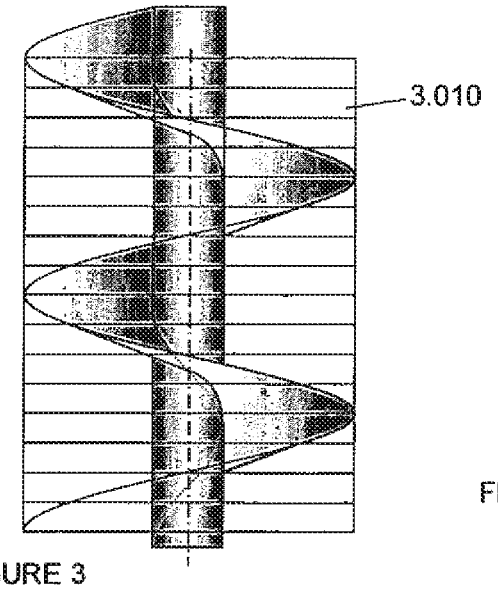
FIGURE 3
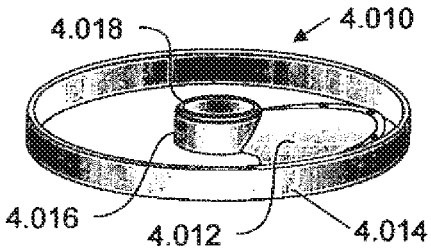
FIGURE 4

FIGURE 5
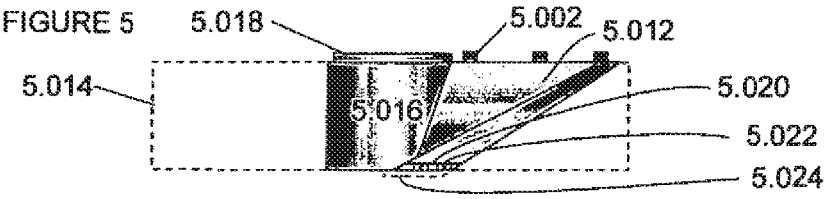
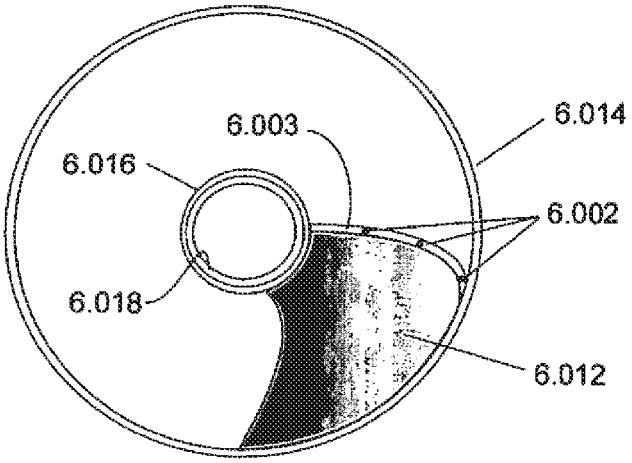
FIGURE 6
FIGURE 7
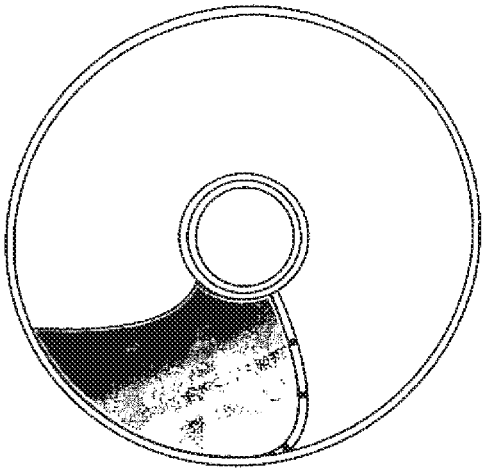
FIGURE 8
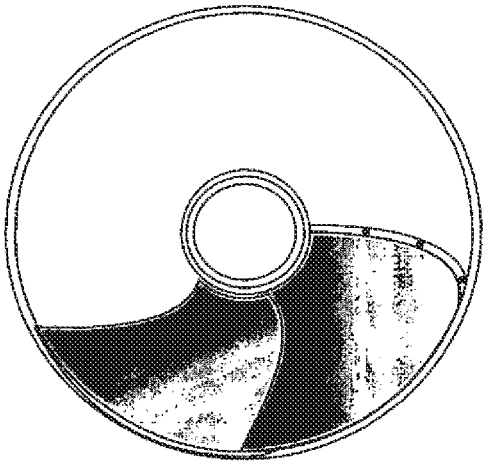

FIGURE 12
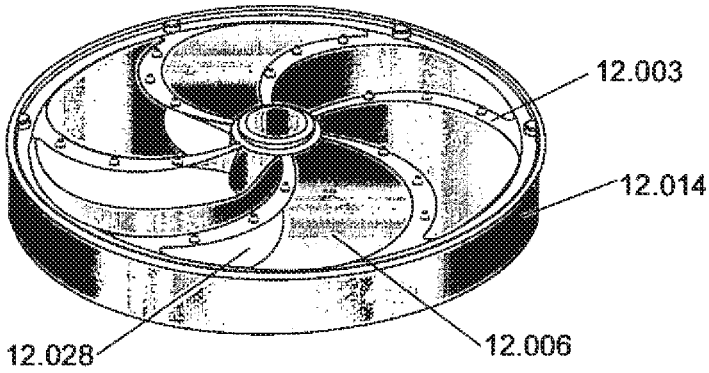
FIGURE 13
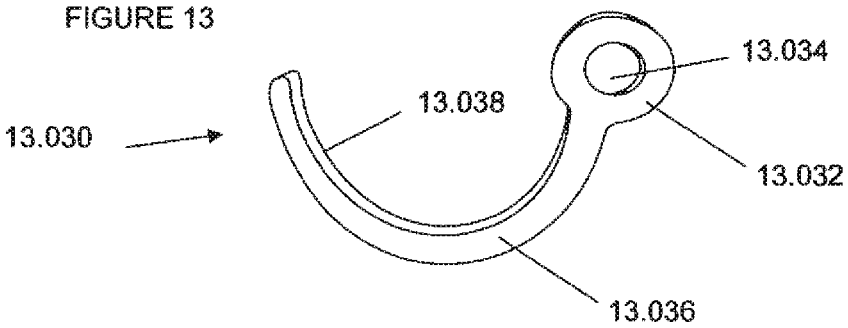
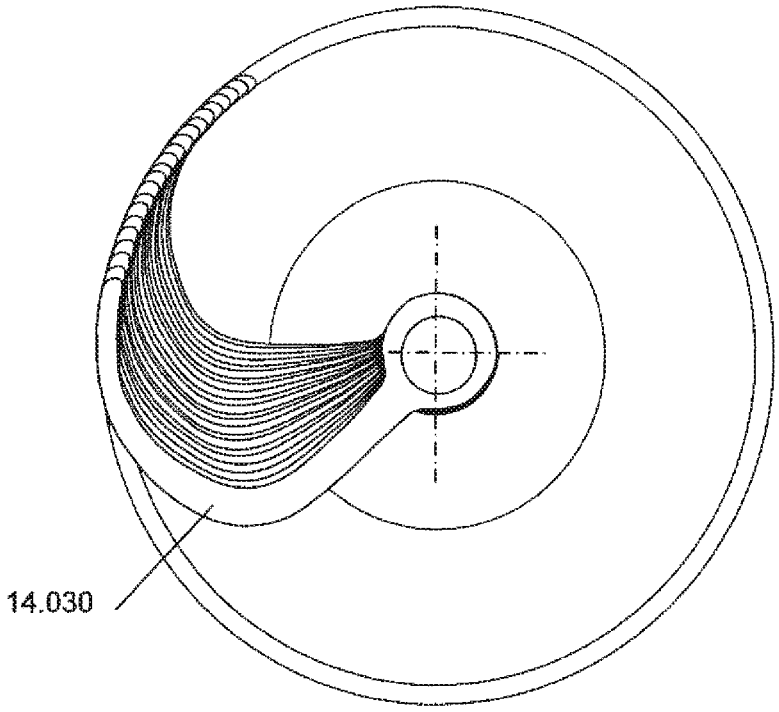
FIGURE 14

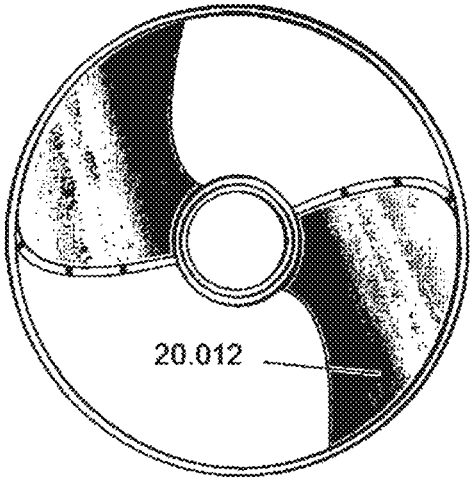
FIGURE 20
FIGURE 21
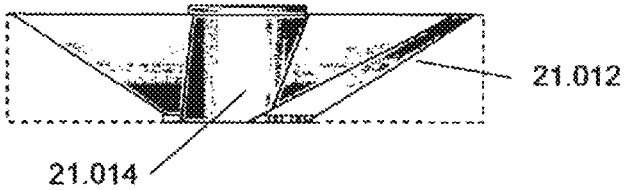
FIGURE 22
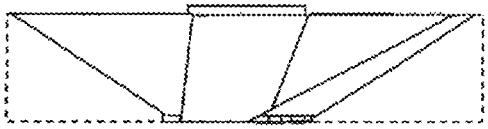
FIGURE 23
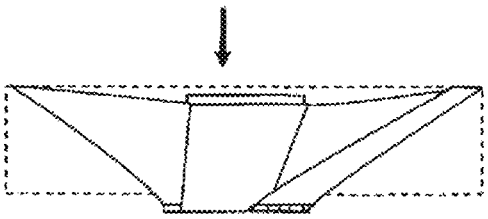

MODULAR SPIRAL SEPARATOR ELEMENTS

FIELD OF THE INVENTION

This invention relates to design, manufacture, assembly and testing of spiral separators and spiral separator modules.

BACKGROUND OF THE INVENTION

Spiral separators are used to separate minerals by providing a descending helical trough down which a mineral slurry flows. A spiral separator can be thought of as a helical sluice. Straight sluices have been used for millennia to recover high-density minerals, most famously gold, from flowing slurries. Records indicate that spiral separators were invented at the end of the 19th century, see for example U.S. Pat. No. 629,595. As the slurry flows down a spiral trough, it is subjected to centrifugal and gravitational forces. The heavier minerals (high-density particles) accumulate toward the inner part of the trough and the lighter minerals (low-density particles) tend toward the outer part of the trough.

Generally, there are three types of product streams from spiral separators and these are commonly termed concentrate, tailings and middlings.

When heavy mineral particles accumulate toward the centre of a spiral they form what is often termed a "concentrate band" rich in heavy mineral.

Spiral separator assemblies can constitute single or multiple helical troughs. Those with multiple troughs are termed "multi-start spirals" in the mineral industry. Common industry nomenclature includes the terms: Single-start, Twin-start, Triple-start and Quad-start, describing spiral assemblies with various numbers of helical troughs.

Conventional spirals are generally arrayed in banks and the slurry is fed to individual spiral troughs, from distributors mounted above the banks, via hoses, pipes and fittings.

An individual trough or helical separating surface will often be referred to in this document as a start.

On a multi-start spiral, multiple troughs are inter-wound on a common axis to increase the feed capacity for a given space. For example, a triple start spiral can treat 3 times as much feed as a single start spiral while occupying an almost identical volumetric space.

It is very uncommon to have more than four starts on a conventional spiral assembly, mainly due to manufacturing and assembly difficulties.

Plastic or aluminium pipes are conventionally utilised as centre columns providing structural support and positional referencing for the troughs in terms of centre, height and spacing.

Spirals are generally assembled by first forming complete, individual troughs. Troughs are then wound together in the case of multi-start spirals and fastened to the column. Other components such as feed boxes, product splitters, product boxes, and repulpers are fitted to complete the assembly.

The invention provides an alternative means of designing, manufacturing, assembling and testing spiral separators.

SUMMARY OF THE INVENTION

According to an embodiment of the invention there is provided a spiral separator module in the form of a segment of a spiral.

According to an embodiment of the invention, there is provided a spiral separator module including a trough segment forming a portion of a spiral trough, the trough segment being adapted to be assembled with one or more trough segments to form a spiral trough.

The module can include attachment means adapted for connection with adjacent modules.

The module can include assembly portion adapted to facilitate assembly of a spiral trough from two or more modules.

The trough segment can extend from the inner edge of the trough to the outer edge of the trough.

An embodiment of the invention provides a spiral separator module including at least one trough segment having an up stream edge and a downstream edge, each trough segment being adapted to interface with at least one other corresponding trough segment of a second spiral separator module to form a continuous section of a spiral trough.

The module can include a segment of a central tube.

The tube can be cylindrical

The module can include a peripheral annular segment.

The module can include a substantially cylindrical outer peripheral wall.

The module can include an inner periphery adapted to conform to a central support.

The inner periphery can include inner support segment.

The inner support can be tubular.

The inner support can be cylindrical.

A number of start elements can be assembled contiguously to form a module.

The segments can be identical.

According to a second embodiment of the invention, there is provided a multi-start element including two or more axially separated segments each segment being part of a respective helical surface.

The downstream edge of each trough segment can be adapted to overlap the upstream edge of the trough segment of the second module.

The configuration of the module can correspond to the inclusion between a pair of parallel planes through a trough.

The planes can be transverse to the axis of the trough.

The configuration of the module can correspond to the inclusion between the intersection of a pair of intersecting planes through a trough.

The planes can be parallel to or coplanar with the axis of the trough.

An embodiment of the invention provides an assembly of modules wherein the modules are substantially identical.

In a further embodiment, the invention can provide an assembly of modules wherein at least one module has a different trough profile.

In an assembly of modules, at least one module can have a different pitch.

In an assembly of modules, at least one module has a different trough angle.

An embodiment of the invention provides thin, cross sectional elements, which are essentially disc-like.

The module can provide a building block for a spiral assembly.

The modules can provide a functional multi-start spiral segment.

Another embodiment of the invention provides vertical modules.

The vertical modules can be in the form of radial segments of a cylinder.

When the elements are assembled in a circular array, they will form a functional single start or multi-start spiral.

During manufacture, the elements can be cast, machined, stamped, printed or otherwise formed from appropriate materials. This provides the potential advantage of mass production with automation and minimal human labour.

The vertical and horizontal modules can include connexion features on the adjoining surfaces to help with alignment, fixing and fastening to each other during assembly of the spiral separators.

In certain embodiments, the modules can "click" together without necessarily requiring a bonding agent.

Spiral profiles, which are essential to metallurgical performance, are inherently built into the design of the elements.

In some embodiments, the spirals can have varying profiles down their length.

Spiral pitch can be designed into the basic elements.

Variations in design of the basic elements can be used to customise spiral assemblies for different duties.

Adding or subtracting elements can further customise a spiral assembly on a more "macro" level.

For difficult separation duties, additional elements can increase the number of turns, thereby increasing the residence time of the feed on the spiral, thereby increasing the separation efficiency.

For less difficult separation, fewer elements can be used to reduce the number of turns where they are not needed and thus save space.

In some embodiments, a number of discs can be fitted together to form a pre-assembly which may constitute, as an example, one or two turns of a six turn spiral.

Pre-assemblies with different characteristics (profile, pitch, inclination) can be interchanged to customise the spiral design for a given application.

Individual discs or individual pre-assemblies or modules with predetermined characteristics can be colour coded to aid in customising complete assemblies.

An embodiment of this invention provides a sub-distributor adapted to be close-coupled to each multi-start spiral assembly or stack of modules so that a single feed hose from the primary distributor can be used to feed all of the starts incorporated in one assembly.

The close-coupled distributor saves height and space by reducing hosing, piping and associated fittings.

The sub-distributor can be a modular component added to the "stack" of elements and can have interfacing surface features for easy connection/assembly.

Splitting and collection of product streams (concentrate, middlings and tailings) can also be accomplished with modular units close-coupled to the bottom of a separation stage.

In one embodiment, the modules can be made of a resilient or elastic material. The profile of the spiral surfaces can be manipulated by applying downward or upward pressure on the centre of the assembly relative to the outer wall of the assembly. This effectively alters the "phase" or relative starting points of the inner and outer edges of the spiral surface. The amount of pressure and the resulting deformation can also be used to control the amount of material that is "split" to either concentrate, middlings and tailings.

In an embodiment, a rotational tube can be inserted down the centre of the spiral assembly and used as a concentrate splitter.

The spiral profile can be designed such that the concentrate band pushes against the centre at various points or alternatively, down the entire length or a section of the length.

The elements can be designed so that at certain points in the assembly there are ports through which concentrate would flow, if allowed.

The rotational tube can have matching ports that align in a given position and do not align in another position with the spiral assembly ports.

Adjustment of the rotational position will regulate the "cut" to concentrate. That is, the amount of material yielded to concentrate can be controlled by the rotational position of the "splitter" tube.

In one embodiment, the spiral assembly (comprised of elemental discs stacked together) will form a full cylinder with no openings. In this case, all of the starts are enclosed.

The modules or a spiral separator made from the modules can be manufactured from one of the following: a transparent; a translucent material; a composite of transparent materials; a composite of translucent materials; a composite of a translucent and a transparent material.

In another embodiment, one of the helical paths can be physically left out, along with its corresponding section of the sidewall, leaving a helical opening through which the action of one of the starts can be viewed.

In a further embodiment with fewer starts, say one, two or three, all of the starts can be open to view.

In an embodiment of this invention, all of the spiral starts in a multi-start assembly begin at equivalent heights and end at equivalent heights.

All of the discharge edges can lie in a single plane.

A rotational splitter can be fitted to the bottom with upper edges that also lie within the same plane.

A rotational splitter with radial, vaned channels can be fitted to the bottom.

The profile of the vanes of the rotational splitter can be shaped to take advantage of the profile of the curved, discharge edges of the starts to enable controlled, adjustable extraction of concentrate or middling.

The plan shape of the splitter device can be star-like with the sides of the arms curved.

Using vertical integration of separate stages of separation, the concentrate stream from an upper stage can be directed to one or more individual starts of a stage on the next level while tailings or middlings can be separately directed to the other remaining starts on the same level. A combination of the "star-splitter" incorporated in a modular distributor can accomplish this in a compact space.

This method of designing and manufacturing spiral separators can be applied to spirals of any diameter. A particular advantage however, occurs with reduced diameter spirals because the smaller scale allows for increased number of turns in a given height. This results in a single stage of separation occurring in reduced height. By vertically integrating a greater number of separation stages, it is possible to achieve final products in a single descent, and thus a single pumping stage, without the plant being inordinately tall. This can greatly simplify spiral separation plants and substantially reduce the operational and capital costs associated with intermediate pumping. A reduction in power reticulation, instrumentation and control systems will be an added benefit.

A resulting reduction in plant footprint will also reduce costs associated with buildings, support structures and access ways.

In conventional spiral manufacture, once a trough is manufactured, its profiles and pitches are fixed and cannot be readily altered. An alternative embodiment of this invention involves very thin elemental discs. The very thin elements may represent a small fraction of a turn; say $1/100^{th}$ or $1/1000^{th}$. When stacked vertically, the slurry will flow down a helical path comprised of very small steps. The amount of rotational "offset" from each disc to the next, dictates the pitch. By allowing the very thin discs to be able to slide rotationally relative to each other, the result is a spiral assembly with an adjustable pitch. Not only can the overall pitch be adjusted, but pitch changes can also be made in localised zones to suit desired slurry speed/behaviour. This is a great advantage to research and development efforts where performance parameters might be measured as a function of pitch. The effects of different pitches can be compared using a single test unit rather than having to manufacture and test a multitude of units.

This method can be used to speed up test programs and gather data for the design of new or customised spirals.

BRIEF DESCRIPTION OF THE DRAWINGS

An embodiment or embodiments of the present invention will now be described, by way of example only, with reference to the accompanying drawings, in which:

FIG. 1 is a schematic representation of a spiral separator;

FIG. 2 is an illustration of the inner and outer helical lines traced by the edges of a spiral separator trough;

FIG. 3 is a schematic illustration of a spiral separator with a horizontal grid superimposed thereon;

FIG. 4 is a schematic illustration of a module of a spiral separator according to an embodiment of the invention;

FIG. 5 is an illustration of a side view of the module of FIG. 4 with the outer perimeter shown in dashed outline;

FIGS. 6 & 7 are plan views of modules as shown in FIG. 4;

FIG. 8 shows the modules of FIGS. 6 & 7 when superimposed;

FIG. 8 illustrates a cylindrical stack of modules;

FIG. 12 illustrates a multi-start module according to an embodiment of the invention;

FIG. 13 illustrates an embodiment of the invention in which the module is formed of a very thin segment;

FIG. 14 illustrates the concept of using very thin elements in which the rotational offset from one element to the next is adjustable and dictates the pitch;

FIG. 20 is a plan view of a 2-start module;

FIG. 21 is a partial X-ray view of the module of FIG. 20;

FIG. 22 is a line illustration of FIG. 21;

FIG. 23 is a view of the module of FIG. 22 with axial force applied to the trough segments and subject to elastic deformation;

Figure 9:
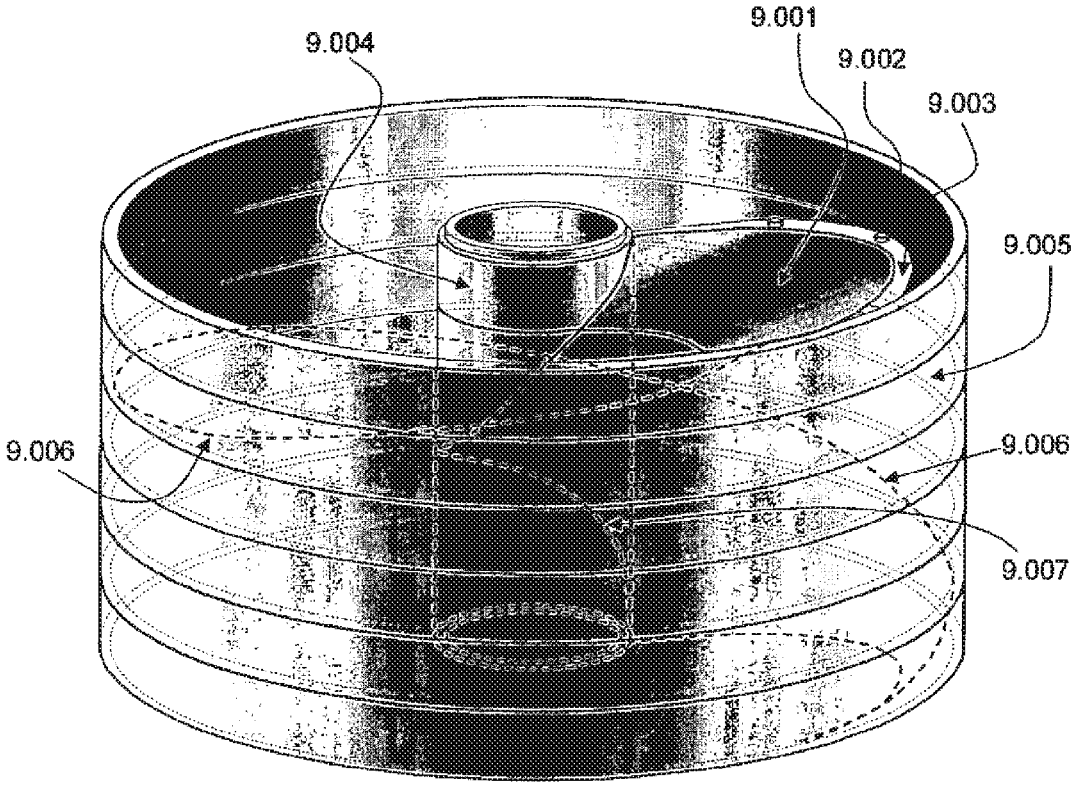
FIG. 9 shows a stack of 6 modules forming a one-turn segment of a single-start spiral assembly.

The numbering convention used in the drawings is that the digits in front of the full stop indicate the drawing number, and the digits after the full stop are the element reference numbers. Where possible, the same element reference number is used in different drawings to indicate corresponding elements.

It is understood that the drawings are intended to be illustrative rather, than exact reproductions, and are not necessarily drawn to scale. The orientation of the drawings is chosen to illustrate the features of the objects shown, and does not necessarily represent the orientation of the objects in use.

DETAILED DESCRIPTION OF THE EMBODIMENT

The invention will be described with reference to the accompanying drawings.

FIG. 1 is a schematic illustration of a single start spiral separator having centre column 1.004 and a spiral trough 1.001 attached to the centre column.

FIG. 2 illustrates the outer edge 2.006 of the spiral and the inner edge 2.007 of the spiral. Both the inner and outer spiral edges have the same pitch, because they maintain a uniform profile for the trough. The inner spiral edge is lower than the outer spiral edge to provide an inward bias for the slurry. In this illustration, 2.005 represents an exterior cylinder enclosing the trough, so the outer spiral edge 2.006 represents the contact line between the trough and the outer cylinder. Similarly, the inner spiral edge 2.007 represents the contact line between the trough and the centre column 2.004. In accordance with an embodiment of the invention, the horizontal lines across the cylinder 2.005 transect the trough into modules such as 3.010, 4.010 shown in FIGS. 3 & 4.

As can be seen from FIG. 2, the inner spiral edge 2.007 is inclined at a steeper angle than the outer spiral edge 2.006. In FIGS. 2, 2.006 and 2.007 represent helical lines in 3-dimensional space. The angle of inclination, is the slope of the drawn line, at the intersection with the dot-dash centre line. This is the point of inflection of the helical line as drawn. Typical down trough angles can be within the range of about 10° to 15° at the outer side of the trough, while the inner side of the trough can be within the range of about 25° to 50°.

FIG. 4 illustrates a module according to an embodiment of the invention. The module includes a central pipe segment 4.016, a trough segment 4.012, and an outer annular segment 4.014.

The spiral trough segment 4.012 is a core element of the invention, in that it is the element from which the complete spiral trough can be assembled. It can be formed of a spiral segment covering a few degrees to half a loop or more. The number of segments required is determined by the designed length of the trough, e.g., the number of turns the spiral trough requires in order to provide the required degree of separation, and the angle covered by each module. Where the segments of the trough modules are identical this is a simple calculation. Where the shape or profile of the trough varies over the length, the modules may have different profiles or may cover different angles, depending on the design criteria.

However, modules need to be designed so that adjacent downstream and upstream edges are compatible. Compatibility does not necessarily require identical curvature. For instance, where the upstream edge overlies the downstream edge of the succeeding trough segment can be sufficient that there be no gap between the edges.

The pipe segment includes a projecting annular rim 4.018 adapted to fit into a corresponding annular recess in the lower part of the pipe segment of a second module.

FIGS. 5, 6, 7, & 8 further illustrate features of the module of FIG. 4.

In FIG. 5, the outer cylinder segment 5.014 is shown in dashed outline. The trough segment 5.012 is shown attached to the pipe segment 5.016, and projecting rim 5.018 projects above the top of the trough segment. The snap fit pins 5.002 project above the top of the trough segment 5.012. The lower edge member 5.020 contains snap fit holes 5.022. Thus the lower edge of the trough segment a first module can be attached to the upper edge of the trough segment of a second module using the pins and holes.

Optionally, the lower edge 5.024 of the trough segment (dashed line), can project below the outer cylinder segment 5.014. This enables the trough segment of an upper module to overlap the trough segment of a lower module when assembled.

As shown in the embodiment of FIG. 5, the top edge of the trough segment 5.012 is coplanar with the top of the outer cylinder segment 5.014, and the top of the pipe segment 5.016, but below the pipe segment projecting rim 5.018. Similarly, the bottom of the trough segment 5.012 is coplanar with the bottom of the outer cylinder segment 5.014, and the bottom of the pipe segment 5.016 if there is no projecting skirt 5.024 on the bottom of the trough segment.

FIG. 6 is a bird's eye view of a module. The pipe segment 6.016 and projecting rim 6.018 are shown at the centre of the module. The trough segment 6.012 extends from the pipe segment 6.016 to the outer annular segment 6.014. In an embodiment, the material from which the module is formed can be homogeneous so as to be amenable to casting. Alternatively, a separate edge member or support brace 6.003 can extend along the upper or upstream edge of the trough segment. A number of first connector elements 6.002 are provided on the brace 6.003. A second edge member (not shown) can be provided along the lower edge of, and beneath, the trough segment. The second edge member can carry second connector elements adapted to cooperate with first connector elements of another module's trough segment. The first connector elements can be, for example, pins, and the second connector elements can be, for example, holes, the pins and holes being adapted to provide a snap fit connection.

FIG. 7 illustrates a second module, substantially identical to the first module, but rotated so the upper edge of its trough segment aligns with the lower edge of the first module of FIG. 6.

FIG. 8 illustrates the module of FIG. 6 superimposed on the module of FIG. 7.

FIG. 9 illustrates a plurality of module segments stacked to form a spiral separator or a section of a spiral separator. The column segments 9.004 are connected to form a continuous centre column, the projecting rims 9.018 fitting into annular recesses in the base of the adjacent column segment to provide mechanical stability and fluid integrity.

The trough segments fit together to conform to the outer spiral edge 9.006 and the inner spiral edge 9.007 thus forming a continuous spiral trough. The lower and upper edges of the adjacent trough segments can also be connected by the pins 9.002 and holes (see 5.022 in FIG. 5).

While the foregoing embodiment has only one start, it will be clear to a person skilled in the technology that each segment can include two or more starts, which can be assembled to form a multi trough separator.

The spiral trough can have a more complex profile or cross-section than that shown in the preceding figures. For example the trough can include a gutter near the inner edge.

FIG. 9 is a schematic showing a stack of six elemental discs. Only a single start (single helical separation surface) is shown for clarity. In this example, the helical separating surface travels through one full revolution as it descends the 6-element-stack. That is, each trough segment effectively covers 60° of rotation.

Figure 10:
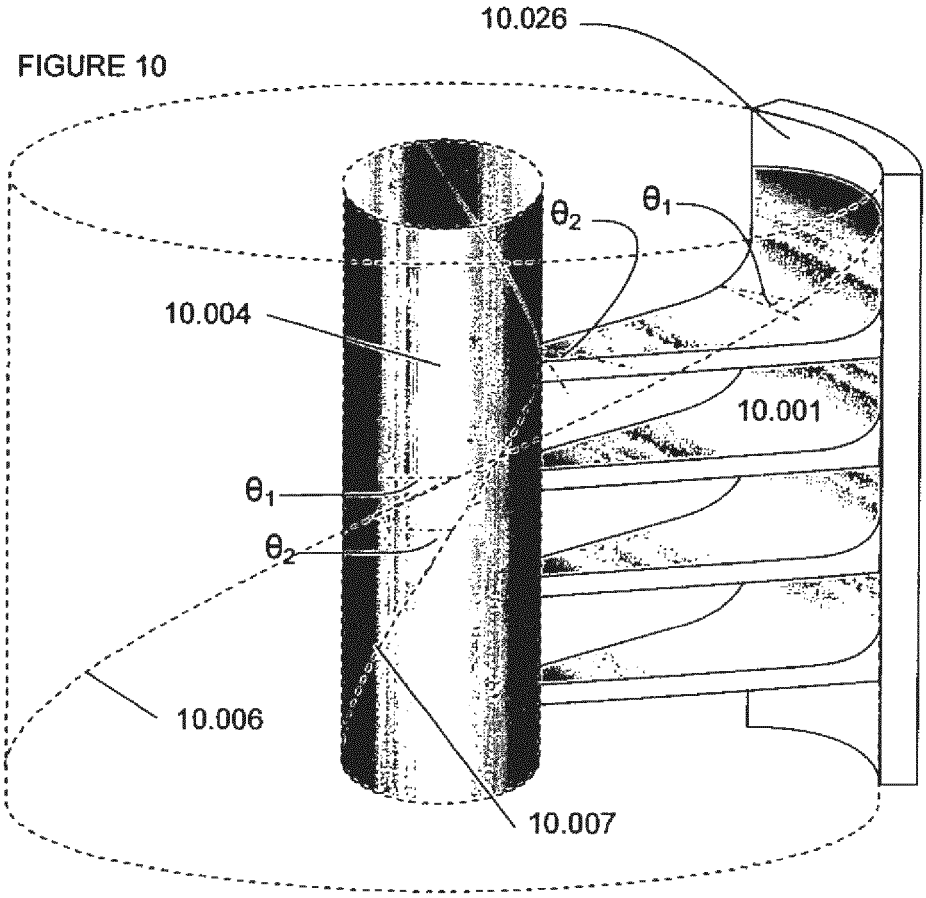
FIG. 10 illustrates schematically the principle of an alternative embodiment of the invention in which the trough segments are divided into radial wedges.

FIG. 10 illustrates schematically the principle of an alternative embodiment of the invention in which the trough segments are divided into radial wedges. This embodiment can be used to implement a multi-start arrangement. For purposes of illustration, the inner wall of the outer cylinder is shown in dashed outline and the outer spiral edge 10.006 is traced on the outer cylinder. Also for purposes of illustration, a complete central column 10.004 is also illustrated, the inner spiral edge 10.007 being drawn on the centre column.

Segments of four separate starts such as 10.001 are formed by a pair of vertical planes intersecting at the axis of the spiral so each start segment appears as a truncated wedge starting at the outer cylinder wall and terminating on the pipe. However, the wedge is twisted to meet the geometric requirements of the spiral trough. Thus the outer edge of the trough is inclined at an angle $\theta_1$, and the inner edge terminates against the corresponding pipe segment at an angle $\theta_2$.

$\theta_1$, is the angle of inclination of the outer spiral measured at the point of inflection, and $\theta_2$, is the angle of inclination of the inner spiral. Because the inner spiral must achieve the same axial displacement per turn as that of the outer spiral to maintain the uniformity of the spiral, $\theta_2$, is larger than $\theta_1$.

Figure 11A:
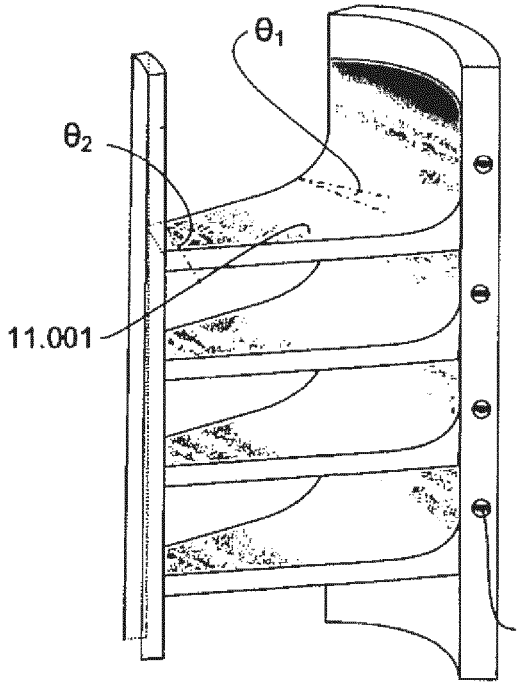
FIGS. 11A & B schematically illustrate a wedge shaped module of a multi-start spiral arrangement according to an embodiment of the invention.
Figure 11B:
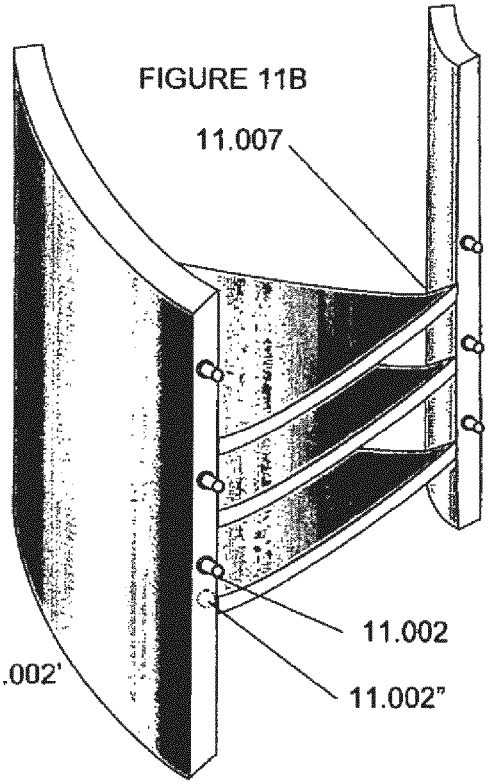

FIGS. 11A & B schematically illustrate a wedge shaped module of a multi-start spiral arrangement based on the factors discussed with reference to FIG. 10. As best seen in FIG. 11B, the inner spiral edge 11.007 is angled steeply downward. This corresponds to $\theta_2$ in FIG. 10.

The module is essentially a radial segment of a cylinder. When these modules are arrayed in a circle, the connector elements 11.002 match edge to edge creating a helical trough surface.

In various embodiments of the invention, these modules can be very thin comprising as little as 1 to 3 degrees of turn or they can comprise as much as ⅓, ½ or even ⅔ of a turn.

FIG. 12 illustrates a multi-start module formed by a pair of parallel planes transverse to the axis of a multi-start spiral. Adjacent pairs of trough segments of the module define trough channels such as 12.028 through which the slurry can pass. As modules are assembled, the corresponding trough segments and trough channels are aligned to form continuous troughs.

There are 6 separation surfaces shown in this example indicating that this would be a 6-start spiral. That is, there would be six helical troughs incorporated in a spiral assembly comprised of a stack of these discs. Modules including other numbers of starts can be built along similar lines without departing from the sprit of the invention.

In this example, one disc comprises one sixth of a complete turn, or revolution, of the helical troughs. Therefore, 6 discs comprise one full turn and a full, 6-turn spiral assembly would require 36 discs. Alternatively, the trough segments can consist of more or less than a sixth of a turn by suitably choosing the depth of the module, i.e., the separation of the transverse planes defining the modules.

In some embodiments, the modules can be identical, making them amenable to mass production.

The upper connecting surface formed by the arms 12.003 radiating from the column segment to the outer cylinder along the top of the trough segments join a corresponding lower connecting arrangement (not shown) of the next disc above it, clicking into place using locating bumps 12.002. The lower connecting surface of the disc above has matching recesses.

The column segment forms a centre boss which contributes structural strength and provides a convenient hollow centre for potentially transporting a stream such as concentrate or wash water. The centre boss can incorporate a raised ring that "clicks" neatly into the bottom of the boss of the next disc above it. When a number of discs are stacked, the connected bosses form an integral centre column.

The outer ring 12.014 provides an outer wall containing the slurry flow.

FIG. 13 illustrates an embodiment of the invention in which the module is formed of very thin disc 13.030 elements which are used to build up a spiral trough in small increments as shown in FIG. 14. The module includes a centre segment 13.032 with a bore 13.034, and an arcuate arm 13.036 forming the trough segment.

In this embodiment, the slurry flows down a helical surface built up of very small steps, like a micro-scale spiral staircase, as shown in FIG. 14. The steps can be small enough that they do not significantly affect the separating mechanisms. The axial face 13.038 can be bevelled to reduce the inter-module step. In one embodiment, the face 13.038 can be profiled to correspond with a preselected trough profile.

In the embodiment illustrated, the elements are offset by approximately 2 degrees in relation to each other. If the elements are free to slide in relation to each other and rotate about the axis, then the pitch can be adjusted. Pitch is a "rise over run" relationship. The "rise" is fixed and dictated by the thickness of the elements. The "run" is adjusted when the rotational offset is adjusted.

The edges of the elements can be bevelled to reduce the affect of the steps.

As the discs in this example lie in a single, horizontal plane, the lines traced by the edges of the elements represent horizontal contour lines.

In this example, the discs lie in a single plane and can therefore be conveniently made from suitable sheet material. However, to vary the desired result, the elements can also be formed into surfaces with compound curves and contours to achieve helical surfaces when assembled in the same way.

While the central bores 13.034 may be used to form a central pipe or column, in an alternative embodiment, the central bores can be fitted over a unitary rod or pipe to support the modules.

Figure 15:
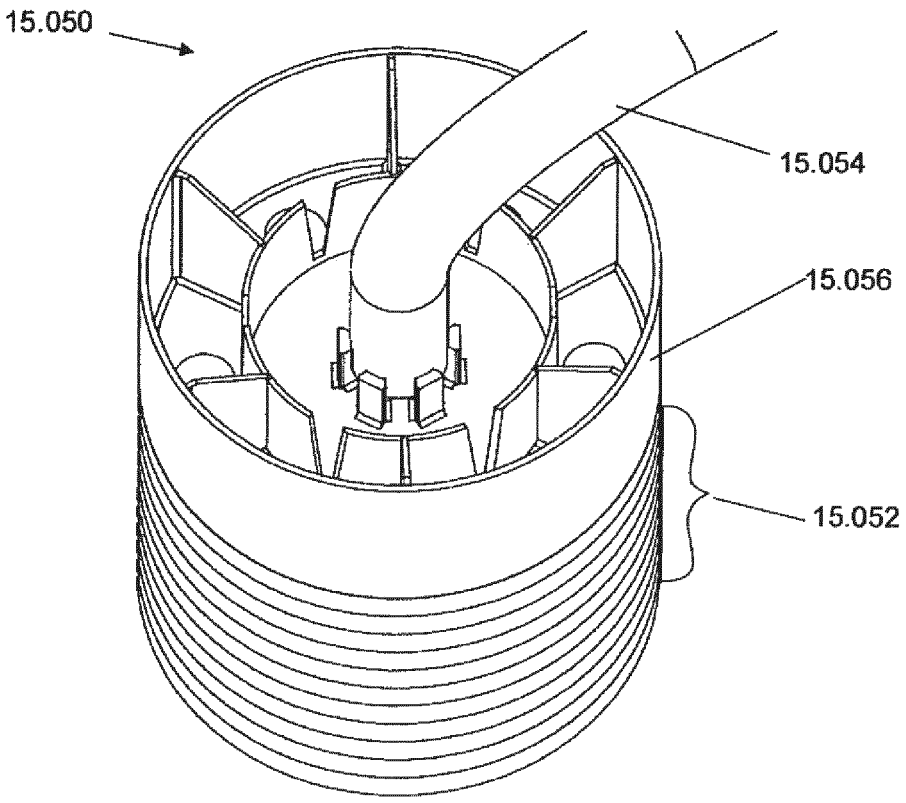
FIG. 15 illustrates a spiral separator arrangement according to an embodiment of the invention.

FIG. 15 illustrates a spiral separator arrangement including a slurry distribution member 15.056 fed by a slurry pipe 15.054. This is arranged on top of a module stack 15.052 similar to that shown in FIG. 9 but with a plurality of starts, such as shown in FIG. 12. The distributor delivers the slurry to the top of each start so that equal flow rates are achieved in each start.

Figure 16:
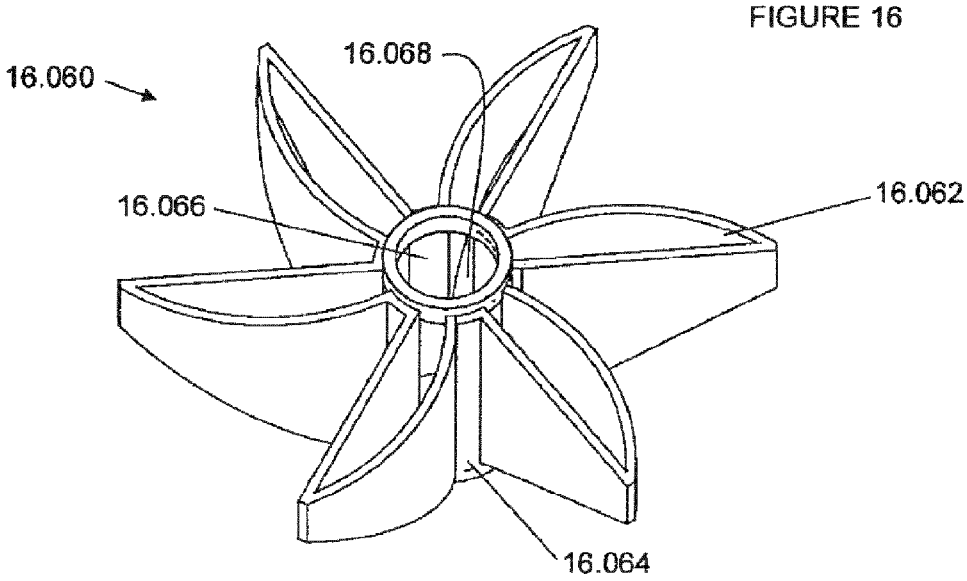
FIGS. 16 and 17 illustrate a splitter arrangement adapted for connection to the bottom of a spiral separator according to an embodiment of the invention.
Figure 17:
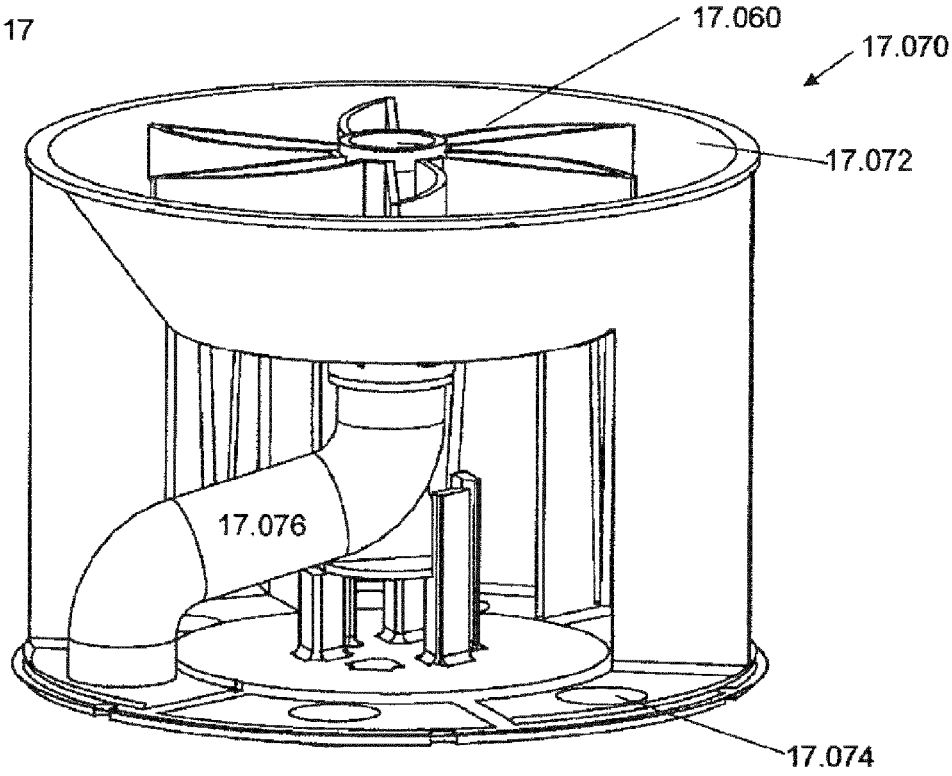

FIGS. 16 and 17 illustrate the splitter arrangement adapted for connection to the bottom of a spiral separator with 6 starts, in accordance with an embodiment of the invention.

The segregation of a concentrate stream can be achieved by a rotational splitter with radial, vaned channels fitted to the bottom of a stack of spiral trough modules.

The profile of the vanes of the rotational splitter can be shaped to complement the profile of the curved discharge edges of the starts to enable controlled, adjustable extraction of concentrate or middling.

The plan shape of the splitter device can be star-like with the sides of the arms curved.

A stream splitting device 16.060 has a plurality of outward projecting duct elements such as 16.062, each connected to a centre cylinder 16.064 and adapted to "feed" the collected concentrate into a corresponding curved conduit 17.076. For further processing, the concentrate flows from 17.076 into one trough of a downstream multi-start spiral separator. The ducts are shaped and dimensioned to collect the concentrate, while the tailings are gathered in bowl 17.072. The collector has a central bore 16.066 into which the ducts 16.062 open, so the concentrate is fed into the central bore, and thence to the outlet pipe 17.076. The tailings can be collected through apertures such as 17.074. The apertures such as 17.074 can be close coupled to corresponding individual troughs of a down stream spiral separator. One of the troughs on the down stream stage will treat the concentrate (from 17.076) acting as a cleaner stage while the other troughs will treat the tailings acting as a scavenger stage. In this way, three stages of processing are achieved in a compact space, e.g. rougher, cleaner and scavenger stages.

Figure 18:
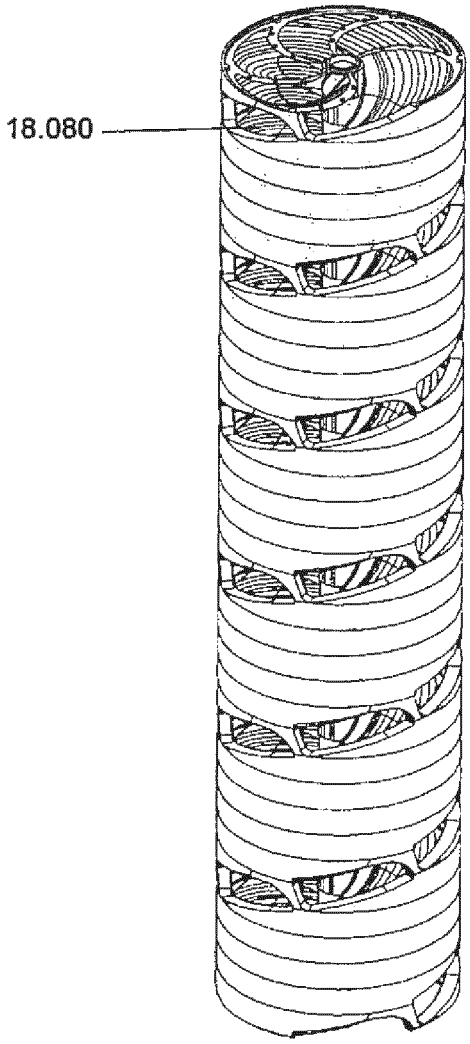
FIG. 18 illustrates a multi-start stack of modules which are provided with observation openings according to an embodiment of the invention.

FIG. 18 illustrates a multi-start stack of modules which are provided with observation openings or windows 18.080. In this embodiment, one of the spirals of a multi-start arrangement is omitted, forming a continuous spiral observation aperture.

Figure 19:
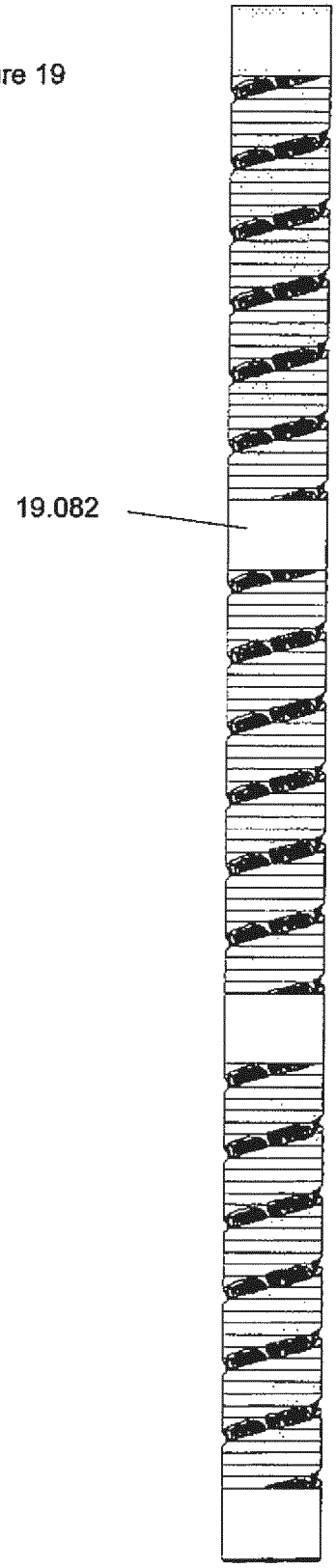
FIG. 19 illustrates a series of separators according to an embodiment of the invention.

FIG. 19 illustrates a plurality of stacks such as shown in FIG. 18 connected in series. Using vertical integration of separate stages, the concentrate stream from an upper stage can be directed to one or more individual starts of a stage on the following assembly at the next level while tailings or middlings can be separately directed to the other remaining starts on the following level. A combination arrangement 19.082 using the "star-splitter" 16.060 incorporated between stages in a modular distributor as detailed in FIG. 17 can accomplish this in a compact space.

When the trough segments are elastically deformable, the relative "phase" of the inner and outer spirals can be adjusted. FIG. 20 is a plan view of a 2-start module having deformable trough segments. FIG. 21 is a partial X-ray view of the module of FIG. 20. FIG. 22 is a line illustration of FIG. 21. FIG. 23 is a view of the module of FIG. 22 with axial force applied to the trough segments, for example by applying axial force to the centre pipe segment relative to the outer cylinder segment. The start segments can deform under the action of the applied force, so that the inner spiral is lower in relation to the outer spiral in the arrangement of FIG. 23 compared with that of FIG. 22.

Figure 24:
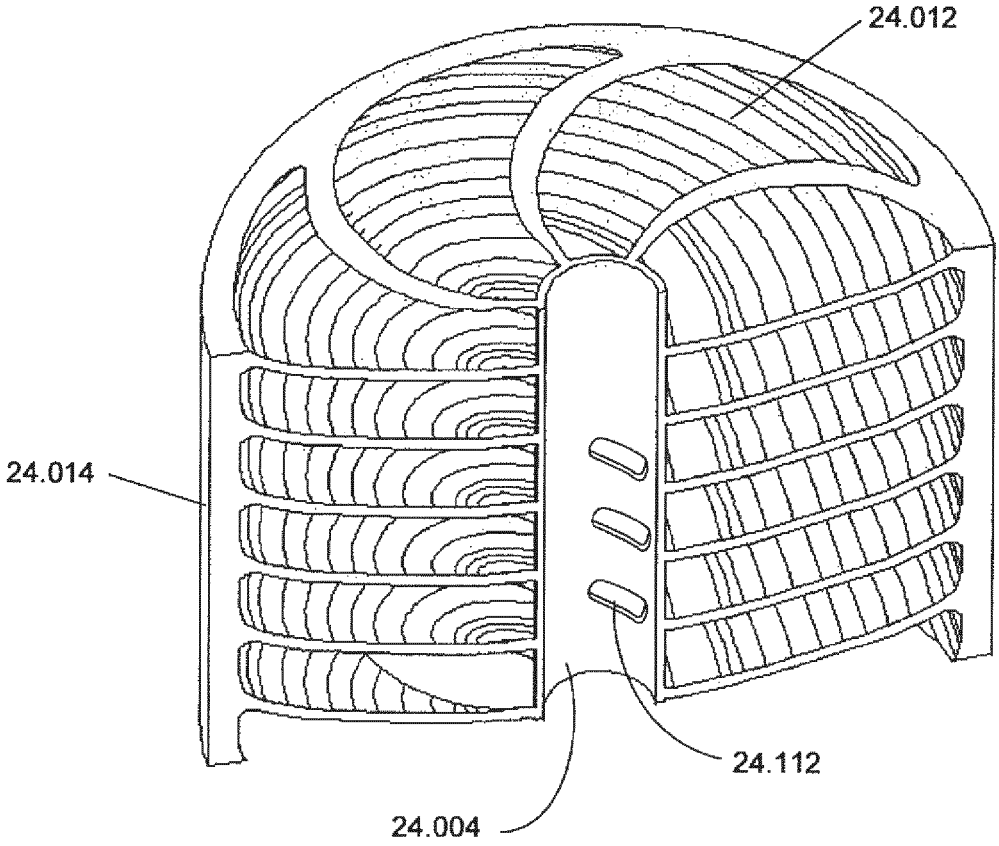
FIG. 24 is a schematic illustration of a multi-start spiral according to an embodiment of the invention.

A spiral with multiple starts can just as easily be formed with this method as can a single start spiral. FIG. 24 illustrates a multi-start spiral module according to an embodiment of the invention. The module is in the form of a 180° vertical section of a multi-start spiral having 6 starts. The drawing includes imaginary spiral lines on each trough surface illustrating the path of a particle which travels down the spiral at a fixed distance from the axis. Such an arrangement can be held together by external bands in place of, or in addition to the in-built attachment arrangements between the individual modules discussed above. An advantage of vertical section modules is that, if a trough becomes clogged during operation, the assembly can be readily disassembled to clear the blockage.

The trough segments such as 24.012 extend from outer wall segment 24.014 to the inner column segment 24.004. Also shown in this figure are outlet ports such as 24.112 which are positioned adjacent to the interface between the trough segments 24.012 and the inner column 24.004 towards the bottom of the spiral where the concentrate has substantially separated from the slurry. At least one port is provided for each spiral trough.

Figure 25:
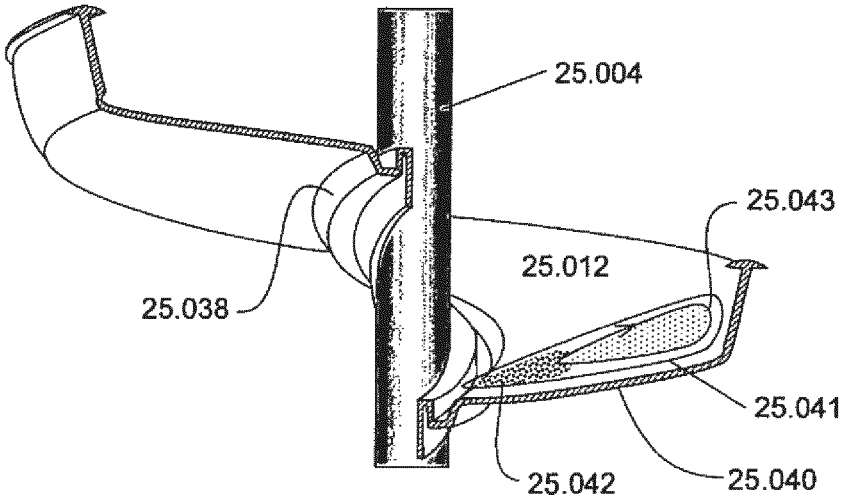
FIG. 25 illustrates a cross-section of a spiral separator trough.
Figure 27:
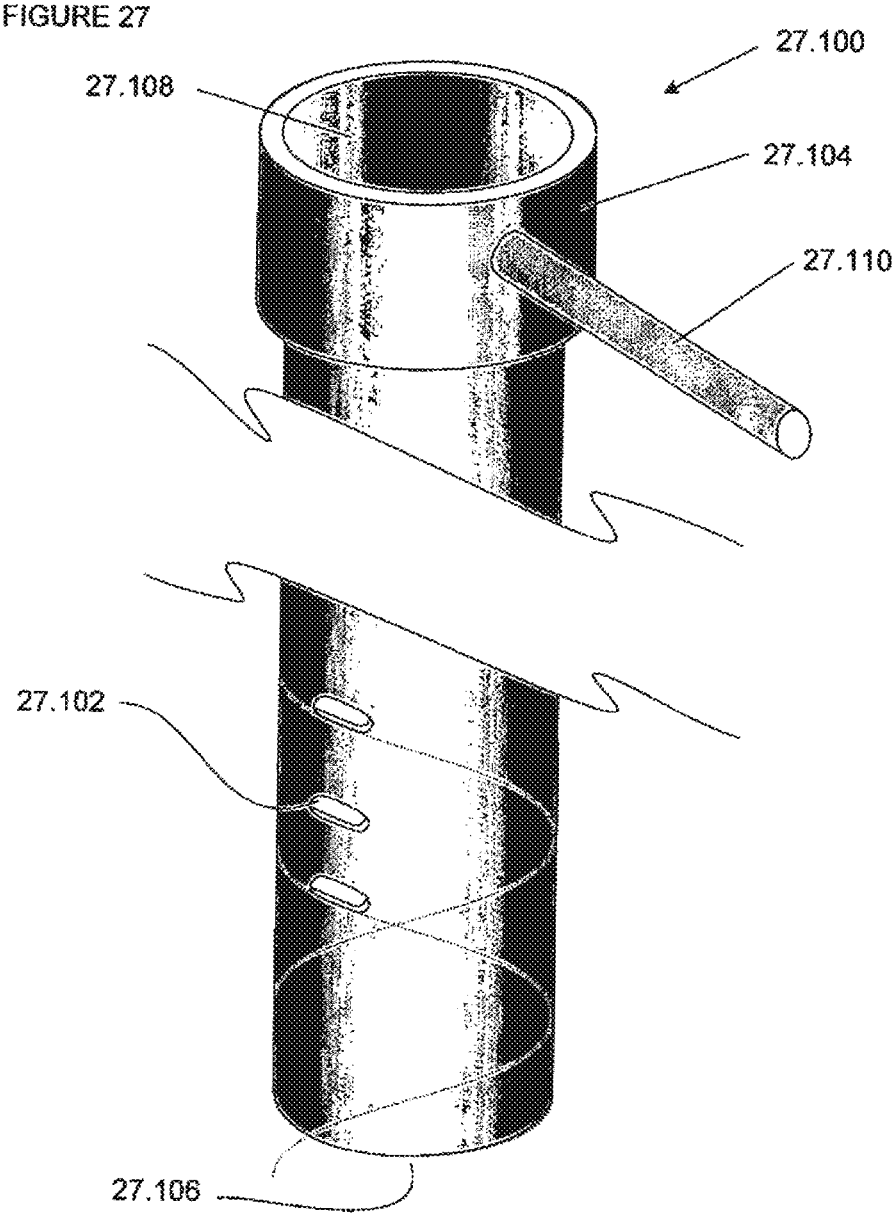
FIG. 27 is a schematic illustration of a porting tube.

FIG. 27 illustrates a concentrate porting arrangement using a ported tube 27.100. The ported tube 27.100, includes one or more ports 17.102, one for each spiral trough. The tube is adapted to be inserted down the centre of the spiral separator, such as the column 24.004 in FIG. 24 which includes one or more corresponding ports 24.112, such as 24.112 in FIG. 24, at the inner column interface where the concentrate collects as schematically illustrated at 25.042 in FIG. 25. The ports 27.102 are located so that, in a first position of the tube within the column, the ports 27.102 align with the ports 24.112 so the concentrate can flow into the centre of the tube 27.100 and down to the outlet 27.106 for collection. The tube can be rotated within the column so that the ports 24.112 are partially or fully occluded by the unported portion of the tube. Instead of rotation, the tube can be raised and lowered to open and close the ports 24.112.

The tube 27.100 is sufficiently long that the outlet is located proximate or outside the bottom of the spiral separator.

Where the tube is moved axially, it can be keyed with the column so the ports can be aligned.

Where the port is rotatable, angular indicators can be inscribed on the tube and column to indicate the degree of alignment.

The tube can be of any suitable cross-section. For example, the tube can be of square cross-section if the central bore of the spiral is square. In the case of a rectangular or other non-circular cross-section, the tube can be raised or lowered in the spiral bore to align the ports of the tube with the ports of the spiral. However, in the embodiment shown, the tube 27.100 is cylindrical and is a close fit within the central bore of the spiral, allowing rotational movement between the tube and the spiral. The rotational tube can be rotated to bring the ports into line or to move them out of alignment. Thus the concentrate can be drawn off when the ports are aligned.

Additional clear water can be added through the top of the tube 27.100 to dilute the concentrate so it can be more easily transported in the associated plant plumbing.

A single stage of separation on a spiral separator generally involves the feed passing through between three and seven turns. Five to seven turns are most common. In a spiral separation plant, the feed is typically subjected to a number of separation stages before a final concentrate of high enough grade is generated and a "throw-away" tailing is produced. Middling, and sometimes tailing, streams are subjected to "scavenger" stages of separation. Concentrate streams are subjected to "cleaner, "re-cleaner" and, sometimes, "finisher" stages of separation as they progress towards a final concentrate. The product streams from one stage are usually pumped to the next stage. The modular nature of this invention can facilitate multiple stages of separation being vertically integrated. This has the advantage of negating intermediate pumping which is expensive in terms of both capital and operational costs.

Vertical integration of spiral stages also does away with intermediate distribution and laundering thus simplifying the plant arrangement, saving space and reducing costs associated with hoses, pipes and fittings.

This method will greatly simplify the manufacture and assembly of spiral separators. Fewer components are required and the method doesn't rely on high-skilled assembly.

With this method, it will be easier to manufacture multi-start spirals with a greater number of starts than is generally practical with conventionally manufactured spirals. Five to ten (or more) starts can be incorporated depending on the design, duty and diameter of the spiral.

A spiral with multiple starts can just as easily be formed with this method as can a single start spiral. FIG. 24 illustrates a multi-start spiral module according to an embodiment of the invention. The module is in the form of a 180° vertical section of a multi-start spiral having 6 starts. The drawing includes imaginary spiral lines on each trough surface illustrating the path of a particle which travels down the spiral at a fixed distance from the axis. Such an, arrangement can be held together by external bands in place of, or in addition to the in-built attachment arrangements between the individual modules discussed above. An advantage of vertical section modules is that, if a trough becomes clogged during operation, the assembly can be readily disassembled to clear the blockage.

Figure 26:
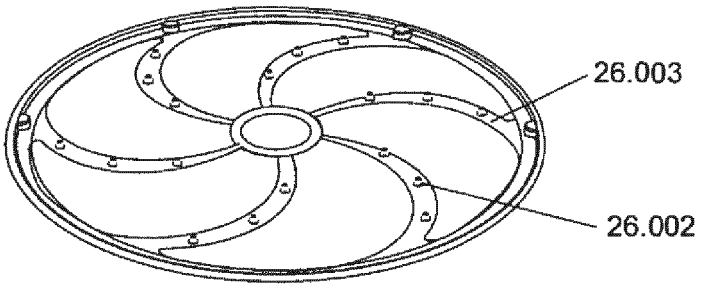
FIG. 26 illustrates a brace member suitable for moulding with a trough segment.

FIG. 26 illustrates a brace member 26.003 which can be inserted into the mould cavity before the trough segments are moulded. The plastics material of the mould can adhere to the brace member 26.003 so the assembled module can be formed during a single moulding process. the attachment projections 26.002 can be integrally formed in the brace 26.003. Alternatively, they can be formed during the moulding process of the same material as the trough segments.

Complete spiral separators can be formed with the modules without the need for further post-assembly operations or time-consuming fixing of the individual members. In particular, the arrangement of the invention is of advantage in relation to multi-start arrangements, because there is no necessity to inter-wind separate troughs. The design of the disc-like elements, or modules, can be such that structural integrity of the assembly is very high. In certain embodiments, the centre column, as a separate component, is made redundant saving costs and labour. However, in some cases it may be convenient to use a centre column.

A further advantage of this invention is that the dimensional relationships between troughs and each other and troughs and the centre column, are inherently designed and built into the modules. Careful measurement and precise joining and fastening of components are substantially eliminated.

In the above described embodiments, the modules are readily manufactured from opaque polymers or plastics material. However, advantages can be derived from the use of transparent and or translucent materials such as polycarbonate, acrylic or polyurethane. Such transparent and or translucent materials provide the ability to see that each of the "starts" in a multi-start unit is running and not blocked. Also, the level of flow in each can be readily visually assessed. The transparency or translucency also allows the ability to identify a partial obstruction or foreign object. It is expect that after a period of use the transparent materials may become translucent due to abrasion, however even in this circumstance some of the previously described advantages will be evident.

Polyurethane is a clear material, and it is preferably used with no pigment, as it has suitable wear resistance for this application. An alternative is to manufacture the modules from dual or composite transparent materials, where a better wear resistant material is used on the spiral module upper surface and a lower cost structural material is used below. It is expected that where low-wear, low-tech, low-cost applications are required that a relatively cheap opaque material will suffice.

In this specification, reference to a document, disclosure, or other publication or use is not an admission that the document, disclosure, publication or use forms part of the common general knowledge of the skilled worker in the field of this invention at the priority date of this specification, unless otherwise stated.

In this specification, terms indicating orientation or direction, such as "up", "down", "vertical", "horizontal", "left", "right" "upright", "transverse" etc. are not intended to be absolute terms unless the context requires or indicates otherwise. These terms will normally refer to orientations shown in the drawings.

Where ever it is used, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

It will be understood that the invention disclosed and defined herein extends to all alternative combinations of two or more of the individual features mentioned or evident from the text. All of these different combinations constitute various alternative aspects of the invention.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, and all modifications which would be obvious to those skilled in the art are therefore intended to be embraced therein.

The invention claimed is:

1. A spiral separator module including at least two trough segments forming a respective portion of at least two spiral troughs, said module being adapted to be assembled with a like module to form multiple spiral troughs of a multi-start spiral separator, including a substantially cylindrical outer peripheral wall.

2. A spiral separator module as claimed in claim 1, including attachment means adapted for connection with adjacent modules.

3. A spiral separator module as claimed in claim 1, including assembly portion adapted to facilitate assembly of multiple spiral troughs from two or more modules.

4. A spiral separator module as claimed in claim 1, wherein each trough segment extends from an inner edge of the trough to an outer edge of the trough.

5. A spiral separator module as claimed in claim 1, including at least one trough segment having an up stream edge and a downstream edge, each trough segment being adapted to interface with at least one other corresponding trough segment of a second spiral separator module to form continuous sections of multi-spiral trough.

6. A spiral separator module as claimed in claim 1, including an inner periphery adapted to conform to a central support.

7. A module as claimed in claim 6, wherein the inner periphery includes an inner support segment.

8. A spiral separator module as claimed in claim 1, wherein the modules are identical.

9. A spiral separator module as claimed in claim 1, wherein the downstream edge of each trough segment is adapted to overlap the upstream edge of a trough segment of a second module.

10. A spiral separator module as claimed in claim 1, wherein the configuration of the module corresponds to at least one of an inclusion between a pair of parallel planes through a spiral trough; the inclusion between a pair of parallel planes through a multiple number of spiral troughs wherein the planes are transverse to an axis of the trough; an inclusion between an intersection of a pair of intersecting planes through a trough; and the inclusion between an intersection of a pair of intersecting planes through a trough wherein the planes are parallel to or coplanar with an axis of the trough.

11. A spiral separator module as claimed in claim 1, wherein modules with predetermined characteristics are colour coded to aid in customising complete assemblies.

12. A spiral separator module as claimed in claim 1, wherein said spiral separator module is manufactured from one of the following: a transparent material; a translucent material; a composite of transparent materials; a composite of translucent materials; a composite of a translucent and a transparent material.

13. A spiral separator module as recited in claim 1, wherein said spiral separator module is manufactured from one or more of a transparent material, a translucent material, a composite of transparent and translucent materials, a composite of translucent materials a composite of a transparent material and a translucent material a resilient material and an elastic material.

14. A spiral separator module as claimed in claim 1, wherein said modules include one or more of the following assembly or attachment means: said upstream edge and said downstream edge include formations which will locate a respective downstream or upstream edge of a second module; said upstream edge and said downstream edge include formations which will secure a respective downstream or upstream edge of a second module; a peripheral wall of said module includes formations located on an upstream side to receive mating formations located on a downstream side of an adjacent module.

15. A spiral separator module as claimed in claim 1, wherein an outer periphery includes at least one observation opening or window.

16. A spiral separator module including at least two trough segments forming a respective portion of at least two spiral troughs, said module being adapted to be assembled with a like module to form multiple spiral troughs of a multi-start spiral separator, and including a segment of a central column.

17. A spiral separator module as claimed in claim 16, wherein said central column is one of cylindrical and tubular.

18. A spiral separator module including at least two trough segments forming a respective portion of at least two spiral troughs, said module being adapted to be assembled with a like module to form multiple spiral troughs of a multi-start spiral separator, and including a peripheral annular segment.

19. A spiral separator being constructed from a plurality of substantially identical spiral separator modules said modules including at least two trough segments forming a respective portion of at least two spiral troughs, said separator having multiple starts, including a segment of a central column.

20. A spiral separator as claimed in claim 19 wherein said modules include first ports at predetermined locations through which concentrate can be diverted.

21. A spiral separator as claimed in claim 19, including one or more of the following: a concentrate splitter formed by a rotational tube inserted into the spiral assembly; concentrate splitter formed by a rotational tube inserted into the spiral assembly wherein the rotational tube has second ports adapted to align in a given position with the first ports; concentrate splitter formed by a rotational tube inserted into the spiral assembly wherein the rotational tube has second ports adapted to align in a given position with the first ports wherein the tube is adjustable to the ports of the tube with the ports of the trough in a first position, and not to align in a second position.

22. A spiral separator as claimed in claim 19, wherein the spiral profile is designed such that the concentrate band is one of the following: adjacent the inner periphery at various points; down a continuous portion of the length of the trough.

23. A spiral separator as claimed in claim 19, wherein a sub-distributor cooperates with each multi-start spiral assembly so that a single feed hose from the primary distributor can be used to feed all of the starts incorporated in one assembly.

24. A spiral separator as claimed in claim 19, wherein a stream splitting device cooperates with the bottom of said spiral separator.

25. A spiral separator as claimed in claim 19, wherein a splitter tube is included which has a tube with one or more ports, the tube being adapted to slide or rotate within a central bore of a spiral splitter, the ports being adapted to move into and out of alignment with corresponding ports in the bore of the spiral splitter.

26. A spiral separator module including at least one trough segment forming a portion of a spiral trough, the trough segment being adapted to be assembled with one or more trough segments to form a spiral trough, said module including a substantially annular or part annular outer periphery.

27. A spiral separator module as claimed in claim 26, including attachment means adapted for connection with adjacent modules.

28. A spiral separator module as claimed in claim 26, including an assembly portion adapted to facilitate assembly of a spiral trough from two or more modules.

29. A spiral separator module as claimed in claim 26, wherein the trough segment extends from an inner edge of the trough to an outer edge of the trough.

30. A spiral separator module as claimed in claim 26, including at least one trough segment having an upstream edge and a downstream edge, each trough segment being adapted to interface with at least one other corresponding trough segment of a second spiral separator module to form a continuous section of a spiral trough.

31. A spiral separator module as claimed in claim 26, including a segment of a central column.

32. A spiral separator module as claimed in claim 31, wherein said central column is one of the following: cylindrical; tubular.

33. A spiral separator module as claimed in claim 26, including a substantially cylindrical outer peripheral wall.

34. A spiral separator module as claimed in claim 26, including an inner periphery adapted to conform to a central support.

35. A spiral separator module as claimed in claim 34, wherein the inner periphery includes an inner support segment.

36. A spiral separator module as claimed in claim 26, wherein the modules are identical.

37. A spiral separator module as claimed in claim 26, wherein the downstream edge of each trough segment can be adapted to overlap the upstream edge of the trough segment of the second module.

38. A spiral separator module as claimed in claim 26, wherein the configuration of the module corresponds to at least one of the following: the inclusion between a pair of parallel planes through a spiral trough; the inclusion between a pair of parallel planes through a multiple number of spiral troughs wherein the planes are transverse to the axis of the trough; the inclusion between the intersection of a pair of intersecting planes through a trough; the inclusion between the intersection of a pair of intersecting planes through a trough wherein the planes are parallel to or coplanar with the axis of the trough.

39. A spiral separator module as claimed in claim 26, wherein modules with predetermined characteristics are colour coded to aid in customising complete assemblies.

40. A spiral separator module as claimed in claim 26, wherein said spiral separator module is manufactured from one or more of the following: a transparent material; a translucent material; a composite of transparent materials; a composite of translucent materials; a composite of a translucent and a transparent material; a resilient material; an elastic material.

41. A spiral separator module as claimed in claim 26, wherein said modules include one or more of the following assembly or attachment means: said upstream edge and said downstream edge include formations which will locate a respective downstream or upstream edge of a second module; said upstream edge and said downstream edge include formations which will secure a respective downstream or upstream edge of a second module; a peripheral wall of said module includes formations located on an upstream side to receive mating formations located on a downstream side of an adjacent module.

42. A spiral separator module as claimed in claim 26, wherein said periphery includes at least one observation opening or window.

43. A spiral separator being constructed from a plurality of substantially identical spiral separator modules, said spiral separator modules including at least one trough segment forming a portion of a spiral trough, the trough segment being adapted to be assembled with one or more trough segments to form a spiral trough, said module including a substantially annular or part annular outer periphery.

44. A spiral separator as claimed in claim 43 wherein said modules include first ports at predetermined locations through which concentrate can be diverted.

45. A spiral separator as claimed in claim 43, including one or more of the following: a concentrate splitter formed by a rotational tube inserted into the spiral assembly; concentrate splitter formed by a rotational tube inserted into the spiral assembly wherein the rotational tube has second ports adapted to align in a given position with the first ports; concentrate splitter formed by a rotational tube inserted into the spiral assembly wherein the rotational tube has second ports adapted to align in a given position with the first ports wherein the tube is adjustable to the ports of the tube with the ports of the trough in a first position, and not to align in a second position.

46. A spiral separator as claimed in claim 43, wherein the spiral profile is such that the concentrate band is one of the following: adjacent the inner periphery at various points; down a continuous portion of the length of the trough.

47. A spiral separator as claimed in claim 43, wherein a sub-distributor cooperates with each multi-start spiral assembly so that a single feed hose from the primary distributor can be used to feed all of the starts incorporated in one assembly.

48. A spiral separator as claimed in claim 43 wherein a stream splitting device cooperates with the bottom of said spiral separator.

49. A spiral separator as claimed in claim 43, wherein a splitter tube is included which has a tube with one or more ports, the tube being adapted to slide or rotate within a central bore of a spiral splitter, the ports being adapted to move into and out of alignment with corresponding ports in the bore of the spiral splitter.

* * * * *